United States Patent [19]

Newton

[11] Patent Number: 5,058,668

[45] Date of Patent: Oct. 22, 1991

[54] ROD GUIDE BEARING ASSEMBLY FOR OIL WELL PUMPING APPARATUS

[76] Inventor: Hille Newton, P.O. Box 6204, Bonnyville, Alberta, Canada, TN9 2G8

[21] Appl. No.: 561,334

[22] Filed: Aug. 1, 1990

Related U.S. Application Data

[63] Continuation-in-part of Ser. No. 428,215, Oct. 27, 1989, abandoned.

[51] Int. Cl.[5] ..... E21B 33/02; E21B 33/08; F16J 15/00

[52] U.S. Cl. ..... 166/84; 166/170; 277/24; 277/64; 277/66

[58] Field of Search ..... 166/82, 84, 170, 177; 277/24, 60, 64, 66, 102, 110, 113, 123; 15/104.04

[56] References Cited

U.S. PATENT DOCUMENTS

| | | | |
|---|---|---|---|
| 1,028,758 | 6/1912 | Mason et al. | 277/64 |
| 1,594,935 | 8/1926 | Force | 277/64 |
| 2,213,923 | 9/1940 | Stuart et al. | 15/104.04 |
| 2,245,007 | 6/1941 | Nixon | 286/34 |
| 2,833,577 | 5/1958 | Reynolds | 277/24 |
| 2,974,983 | 3/1961 | Meyer | 277/24 |
| 3,209,830 | 10/1965 | Orr et al. | 166/84 |
| 4,099,562 | 7/1978 | Mattoon | 166/84 |
| 4,289,294 | 9/1981 | McLean | 251/62 |
| 4,345,766 | 8/1982 | Turanyi | 277/30 |
| 4,621,386 | 11/1986 | Hill | 166/82 |
| 4,647,050 | 3/1987 | Johnson | 277/19 |
| 4,896,367 | 1/1990 | Newton et al. | 384/16 |

FOREIGN PATENT DOCUMENTS

| | | | |
|---|---|---|---|
| 723454 | 12/1965 | Canada | 166/57 |
| 1208715 | 1/1966 | Fed. Rep. of Germany . | |

*Primary Examiner*—Bruce M. Kisliuk
*Attorney, Agent, or Firm*—John E. Reilly

[57] ABSTRACT

In well pumping apparatus in which a polished rod is arranged for extension through a stuffing box at the upper end of a wellhead, the stuffing box assembly having a pair of axially spaced bearing assemblies and packing coils positioned between rod guide members at either end of the assembly to guide the polished rod for reciprocal movement along a vertical path through the wellhead. Each rod guide member is composed of an inert material and provided with a liner portion occupying the annular space between an exposed end of the stuffing box and the polished rod in such a way as to retain alignment of the polish rod in its reciprocal movement through the stuffing box. In a modified form, the lowermost liner portion has scraper rings mounted in internal grooves to remove scale build-up on the polished rod, reduce packing wear and minimize leakage.

5 Claims, 3 Drawing Sheets

ROD GUIDE BEARING ASSEMBLY FOR OIL WELL PUMPING APPARATUS

CROSS REFERENCE TO RELATED APPLICATIONS

This application is a continuation-in-part of Ser. No. 428,215, filed 27 Oct. 1989 entitled ROD GUIDE BEARING ASSEMBLY FOR OIL WELL PUMPING APPARATUS, now abandoned, by Hille Newton.

This invention relates to oil well pumping apparatus; and more particularly relates to a novel and improved apparatus for retaining alignment of a polished rod of an oil well pump with the packing coils of a stuffing box assembly so as to reduce packing wear and leakage.

BACKGROUND AND FIELD OF THE INVENTION

In well pumping apparatus, it is customary to employ a stuffing box at the wellhead to prevent oil, water and gases produced under pressure by the pumping apparatus from escaping into the atmosphere.

Generally, the stuffing box is disposed in surrounding relation to the polished rod in order to guide or center the polished rod for vertical reciprocal movement without the escape of produced liquids or gases. Typically, the stuffing box is able to prevent the loss of produced liquids or gases by utilization of a series of packing coils which are compressed within the stuffing box by bearings at opposite ends of the coils and are squeezed or otherwise forced against the coils by threaded end members. The stuffing box is connected directly into the well production string, for example, by threading the lower end of a pack off assembly into a conventional flow tee or pipe fitting.

It is important that the polished rod be centralized in the stuffing box. If the polished rod is not centralized, excessive packing wear and leakage can result. For instance, excessive packing wear will allow the escape of produced fluids and gases into the environment.

It is well known that leakage of fluids and gases is often encountered in oil well stuffing boxes due to packing wear. This condition may be alleviated by providing a better means of centralizing the polished rod in the stuffing box. By accurately centralizing the polished rod in the stuffing box, the stress of centralizing the polished rod will be taken from the stuffing box packing material. By taking the centralizing stress off the packing material, packing material wear will be reduced. By reducing stuffing box packing material wear, leaking or emissions of produced fluids and gases may be reduced.

It has been found that greater efficiencies can be realized both in down time and in preventing the escape of fluids and gases into the atmosphere from a pumping well through the utilization of a novel and improved rod guide assembly which will accurately center and guide the polished rod for reciprocation. Utilization of a rod guide assembly or other bearing assembly is further enhanced by incorporating one or more scraper rings into one of the guide members to minimize scale build-up as well as the amount of pressure that must be exerted on the packing material in the assembly.

SUMMARY OF THE INVENTION

It is therefore an object of the present invention to provide for a novel and improved stuffing box assembly for a well pumping apparatus.

Another object of the present invention is to provide in a well pumping apparatus for a stuffing box assembly which is capable of maintaining alignment of the polish rod and reducing stuffing box packing material wear.

A further object of the present invention is to provide for a stuffing box assembly for polished rods and the like which effectively retains the packing coils in place and properly aligns and centers the polished rod for reciprocation along the desired vertical path in an effective and dependable manner.

An additional object of the present invention is to provide in a well pumping apparatus for internally mounted scraper elements in a stuffing box assembly engageable with a polished rod to reduce scale build-up, prevent foreign particles from entering the stuffing box packing as well as to reduce the amount of pressure that must be exerted on the packing material in order to form an effective seal.

It is still a further object of the present invention to provide in a stuffing box assembly for polished rods for novel and improved scraper elements to prevent the entry of grease from the polished rod into the interior of the stuffing box assembly.

In accordance with the present invention, there has been devised for use in a well pumping apparatus in which a stuffing box is mounted at the upper end of a well head and a polish rod is reciprocal along a vertical path on the vertical axis of the stuffing box, the improvement of one or more rod guide assemblies in axially spaced relation to one another in the stuffing box, packing coils in the stuffing box interpositioned between the guide members, each guide member being annular and at least one including an elongated reduced diameter portion designed to guide the polish rod through the stuffing box, and an enlarged shoulder portion including means for exerting an axial compressive force on the packing coils in surrounding relation to the polish rod. Preferably, each rod guide member is composed of an inert material and at least at the external ends of the stuffing box have a liner portion occupying the annular space between the stuffing box and the polish rod in such a way as to properly align and center the polish rod for reciprocation along the desired path of travel while minimizing leakage of oil, gas or other fluids. Another feature of the present invention is to position one or more scraper rings in an internal groove provided for each ring in the lowermost of the guide members, the scraper ring(s) being mounted under compression to bear against the surface of the polish rod.

It is desirable in accordance with the present invention to employ upper and lower rod guide members both in the stuffing box and a pack off unit beneath the stuffing box with packing coils interpositioned between both sets of the guide members, and coiled scraper elements are mounted under compression at the lowermost of the guide members in the pack off unit so as to most effectively perform the desired functions of scale removal and grease retention.

The above and other objects, advantages and features of the present invention will become more readily appreciated and understood from a consideration of the following detailed description of preferred and alternate forms thereof when taken together with the accompanying drawings, in which:

DETAILED DESCRIPTION OF THE PREFERRED EMBODIMENT

Figure 1:
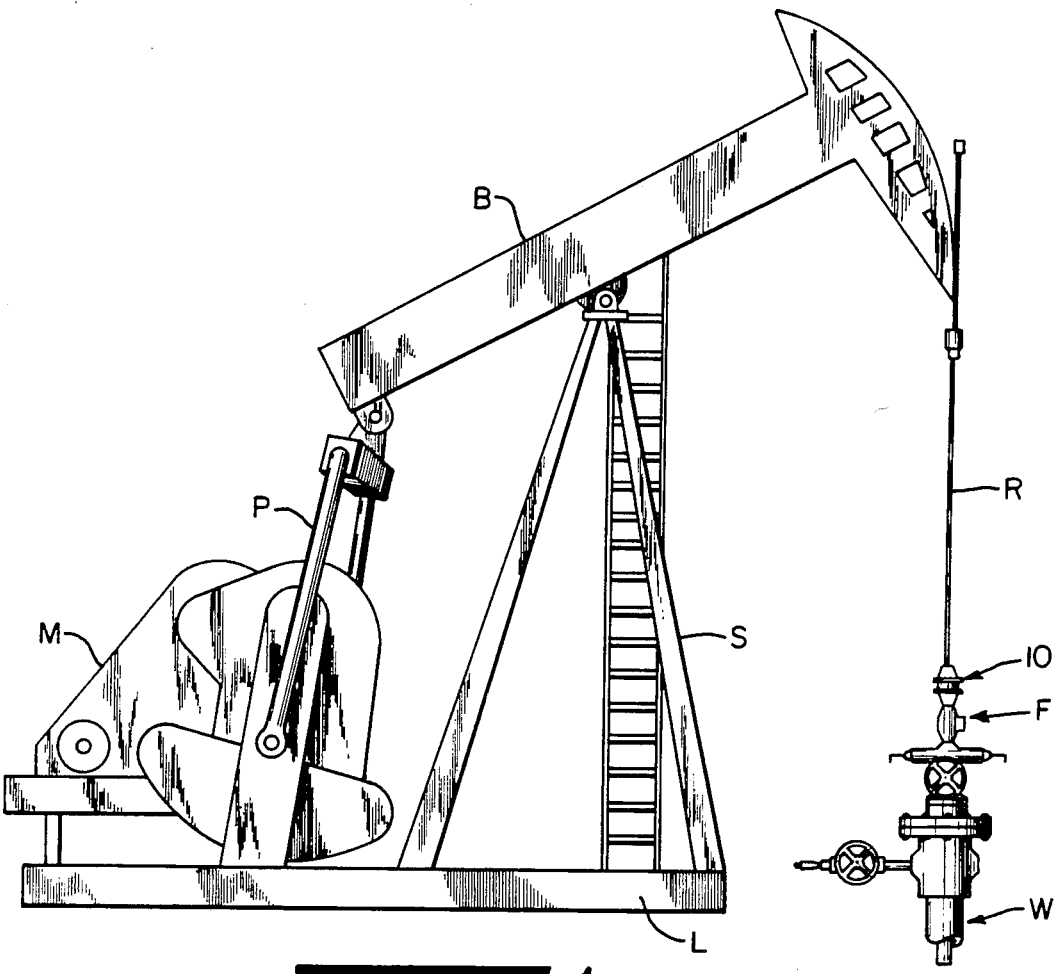
FIG. 1 is a schematic view of a pump jack and wellhead with a preferred form of stuffing box assembly mounted at the wellhead in accordance with the present invention.

Referring in more detail to the drawings, there is illustrated in FIG. 1 a preferred form of stuffing box assembly 10 at the upper extremity of a wellhead W. A polished rod R is arranged at the end of a walking beam B for downward vertical extension through the stuffing box assembly 10 and the wellhead W under the control of a pumping apparatus consisting of a motor drive M and pitman P at one end of the beam opposite to the polished rod R.

Figure 2:
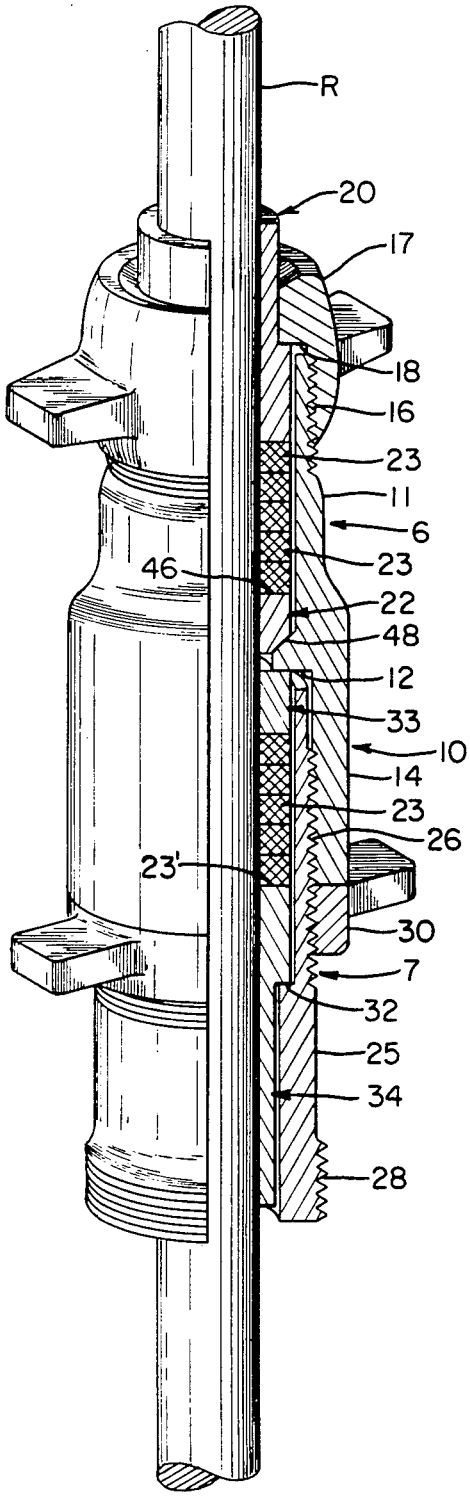
FIG. 2 is a view partially in section of a preferred form of stuffing box assembly in accordance with the present invention.

In accordance with conventional practice, the walking beam is mounted on a Samson Post S which is supported on a base pad L. As shown in FIG. 2, the stuffing box assembly 10 is broadly comprised of an upper stuffing box 6 and lower pack off unit 7 which are threadedly interconnected in end-to-end relation to one another. The outer body of the stuffing box 6 is of conventional construction and made up of an outer, hollow cylindrical fitting 11 having an internal shoulder 12 at its lower end and a downwardly depending, generally cylindrical skirt 14. The upper end of the fitting 11 is externally threaded as at 16 and a top cap 17 has internal threading for engagement with mating external threading 16 on the fitting 11. The upper extremity of the cap 17 has an inwardly directed shoulder 18.

An important feature of the present invention resides in a rod guide assembly which is contained within the upper stuffing box 6 and is broadly comprised of a top rod guide member 20 and bottom rod guide member 22 between which are interposed a series of packing coils 23. The top and bottom rod guide members 20 and 22 will be hereinafter described in more detail, but are positioned at opposite ends of the upper stuffing box 6 to retain and to compress the packing coils 23 therebetween in response to inward or downward threading of the cap 17. The packing coils 23 are of conventional construction, being of generally annular configuration and suitably composed of asbestos, synthetic yarn, carbon or similar material and dimensioned to be of an internal diameter corresponding to that of the external diameter of the polished rod R.

The lower pack off assembly 7 is made up of an elongated, hollow cylindrical fitting 25 which is externally threaded as at 26 to threadedly engage complementary threading on the internal surface of the downwardly depending skirt 14 of the upper stuffing box 6. External threading 28 at the lower end of the fitting 25 is adapted to be threadedly connected directly into the oil well production string and specifically into the upper flow tee, designated F on the wellhead W. A lock nut 30 is disposed at the lower end of the skirt 14 to threadedly engage the fitting 25 along the threaded portion 26. A rod guide assembly similar to that described with reference to the stuffing box 6 is comprised of an upper rod guide member 33 and lower rod guide member 34 with packing coils 23 therebetween. This assembly is mounted within the fitting 26 between an undersurface of the shoulder 12 and an internal shoulder 32 on the fitting 25. In a manner similar to that described with reference to the stuffing box 6, compressive forces exerted on the pack off unit 7 are operative to compress the packing coils 23 whereby to seal any fluids or gases against escape through the pack off assembly 7, for example, when the stuffing box 6 is disassembled or being repaired.

Figure 4:
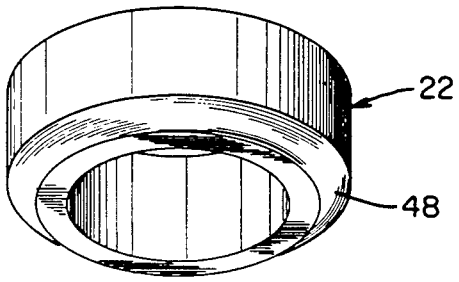
FIG. 4 is an enlarged view of the lower bearing of the stuffing box shown in FIG. 2.
Figure 3:
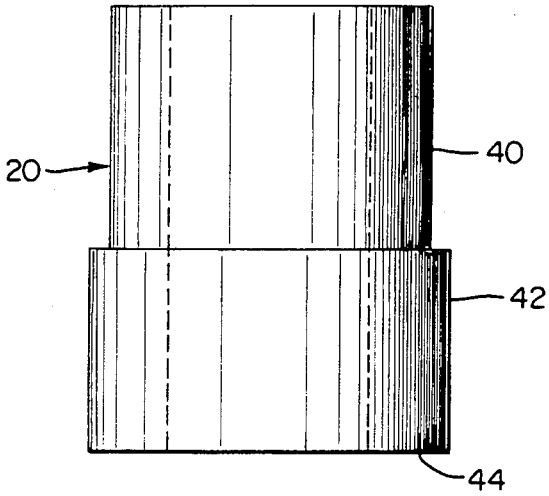
FIG. 3 is an enlarged view of a top bearing in the preferred form of stuffing box shown in FIG. 2.

Referring in more detail to FIG. 3, there is illustrated a preferred form of rod guide member 20 comprised of a hollow cylindrical member having a stepped cylindrical exterior to define an elongated reduced diameter portion 40 extending upwardly as a liner through the upper end or cap 17 and an enlarged shoulder portion 42 engaging the internal shoulder on the cap 18; and a lower squared end surface 44 bears against the upper end surface of the packing coils 23. As illustrated in FIG. 4, a bottom rod guide member 22 is positioned in the lower end of the stuffing box 6 to assist in aligning the polished rod R and to exert a compressive force against the lower end surface of the packing coils 23 in the stuffing box. To this end, the rod guide 22 has a wall thickness corresponding to that of the thickened shoulder portion 42 of the upper rod guide and has an upper squared end surface 46 which bears against the lower surface of the packing coils 23. The lower end of the rod guide 22 is tapered as at 48 to correspond to the tapered or inclined surface of the internal shoulder portion 12 of the stuffing box 6.

In assembling the rod guide members 20 and 22 into the stuffing box 6, the bottom rod guide 22 is first placed in the lower end of the stuffing box packing cavity. The cavity above the bottom rod guide 22 is filled with the packing coils 23 followed by insertion of the upper guide member 20 which is disposed in surrounding relation to the polished rod R. The top cap 17 is threaded onto the upper end of the stuffing box 6 and is tightened to the extent necessary to compress the packing coils 23 between the rod guide members 20 and 22 so as to contact the external surface of the polished rod R.

Figure 5:
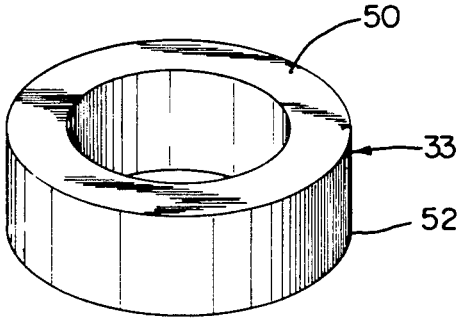
FIG. 5 is an enlarged view of the upper bearing of the lower pack off unit of the assembly.
Figure 6:
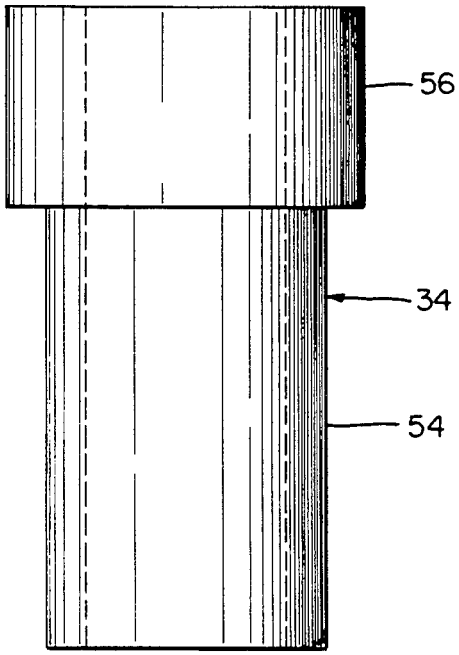
FIG. 6 is an enlarged view of the lower bearing of the lower pack off unit of the assembly shown in FIG. 2.

In the lower pack off assembly, as shown in FIG. 5, the upper rod guide member 33 is a hollow cylindrical or annular member having an upper squared end surface 50 disposed within the fitting 25 and an external surface 52 between the shoulder 12 and the packing coils 23. In turn, as shown in FIG. 6, the lower rod guide member 34 has a reduced diameter, liner portion 54 projecting downwardly through the greater length of the fitting 25 from the internal shoulder 32, and an external shoulder portion 56 on the rod guide 34 is interposed between the internal shoulder 32 and the packing coils 23. By rotating the stuffing box and in particular the fitting 25 in a direction to cause tightening or upward movement of the shoulder 32 against the lower rod guide member 34, the packing coils 23 are once again compressed between the upper and lower rod guide members 33 and 34 in the pack off unit 7.

Typically, in producing oil wells with a beam type pump jack and a vertically reciprocal down hole pumping system, there are severe wear stresses on the stuffing box packing material. This is greatly minimized by utilization of the rod guide members at opposite ends of the packing coils which can be precisely dimensioned to fill the annular space between the opposed ends of the stuffing box assembly and fully encircle the polished rod and better assure alignment as well as resistance to leakage as the polished rod R is reciprocated through the stuffing box assembly. Preferably, the rod guide members both in the stuffing box 6 and pack off unit 7 are composed of an inert material, such as, brass or bronze and, as stated, are accurately dimensioned so as to fill the annular clearance spaces at the ends of the units 6 and 7 whereby to minimize any lateral play or movement of the rod as it moves through the stuffing box assembly 10.

DETAILED DESCRIPTION OF MODIFIED FORM OF INVENTION

Figure 7:
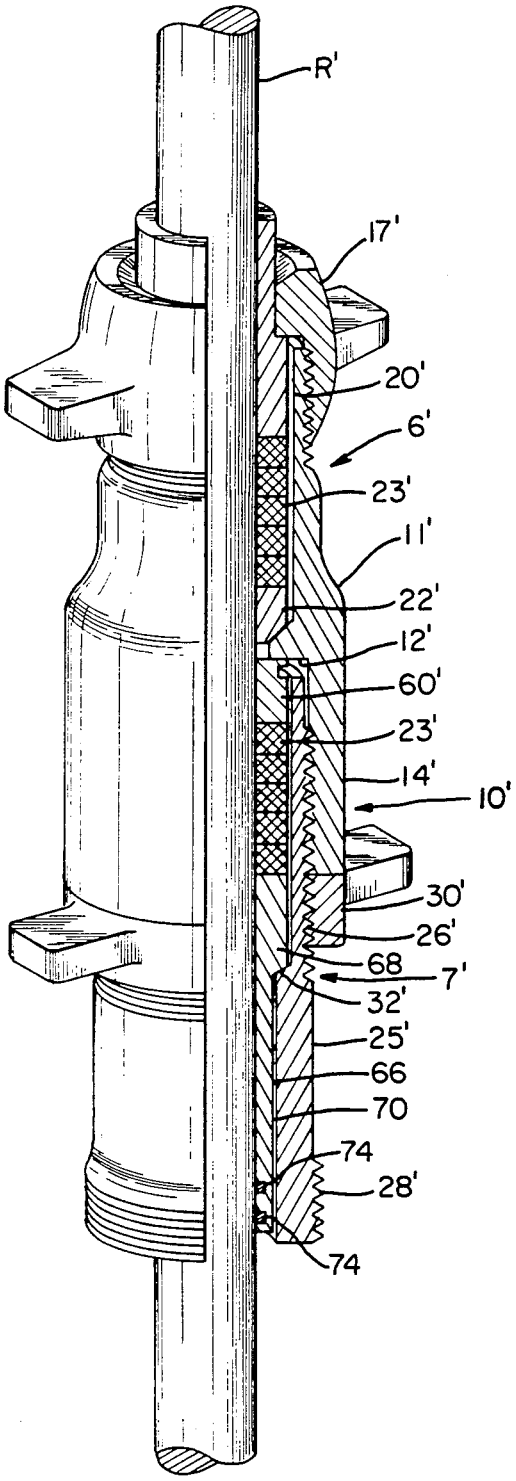
FIG. 7 is a perspective view partially in section of a modified form of stuffing box assembly.
Figure 9:
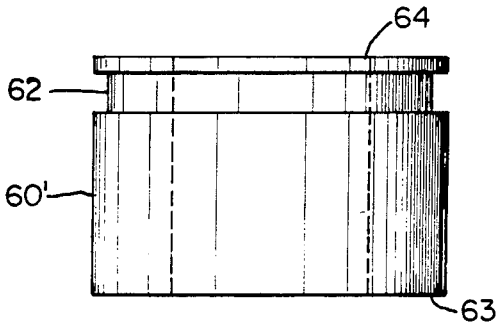
FIG. 9 is an enlarged view in elevation of the upper rod guide member of the pack off unit of the assembly.
Figure 8:
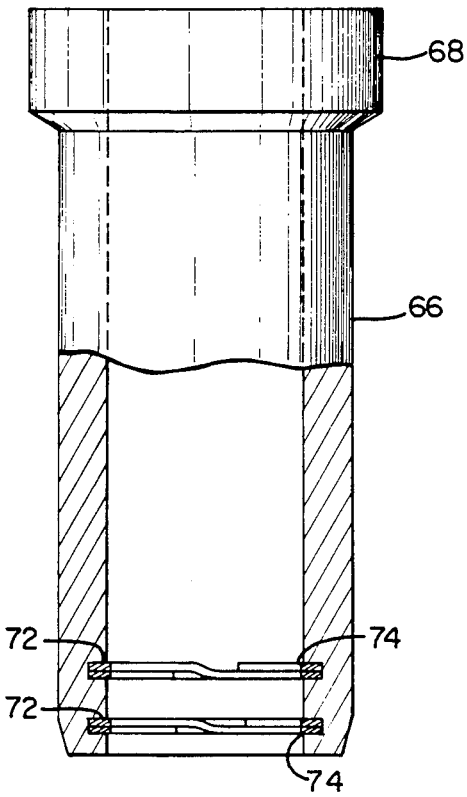
FIG. 8 is an enlarged view partially in section of the modified form of lower rod guide member of the pack off unit of the assembly.

There is illustrated in FIGS. 7 to 9 a modified form of stuffing box assembly 10' wherein like parts to those illustrated in FIGS. 1 to 6 are correspondingly enumerated with prime numerals. The upper stuffing box 6' corresponds in all particulars to the stuffing box 6 of the preferred form and therefore its description will not be repeated other than to generally note that it includes an outer, hollow cylindrical fitting 11' having an internal shoulder 12' and a downwardly extending, generally cylindrical skirt 14'. Again, the top rod guide member 20' and bottom rod guide member 22' are positioned above and below a series of packing coils 23' to compress the coils 23' by tightening of the cap 17'.

The lower pack off unit 7 includes a hollow cylindrical fitting 25' with external threading 26' to engage complementary threading on the internal surface of the skirt 14'. The lower end of the fitting 25' is externally threaded as at 28' for connection into the oil well production string. Lock unit 30' is threaded onto the externally threaded portion 26' directly beneath the skirt 14'.

In the modified form of rod guide assembly for the lower pack off unit 7', an upper rod guide member 60', as shown in FIGS. 7 and 9, is a hollow cylindrical body with an external circumferential groove 62 at its upper end, an upper squared end surface 64 and a lower squared end surface 63. The member 60' is disposed within the upper end of the fitting 25' with the end surface 64 bearing against the undersurface of the shoulder 12' and the lower end surface 63 bearing against the packing coils 23' in the lower pack off unit. The purpose of the external groove 62 is merely to facilitate the removal of the upper rod guide member 60' from the pack off unit 7' for, repair or replacement.

The lower rod guide member 66 includes an upper external shoulder portion 68 and a liner portion 70 of reduced diameter which extends downwardly through the greater length of the fitting 25' with the shoulder portion 68 resting on the internal shoulder 32' of the fitting 25'. A pair of axially spaced internal grooves 72 are disposed at the lower end of the liner 70 and are sized for snugfitting insertion of scraper rings 74. Preferably, each scraper ring is made up of a spiral coil having a plurality of turns of thin-sectioned spring steel. The rings are inserted under radial compression in the grooves 72, and the internal diameter of each ring 74 is such that it will intrude from the grooves and bear firmly against the external surface of the polished rod R'. One suitable form of scraper ring is the Spiro Lox scraper ring manufactured and sold by TRW Canada, Ltd., St. Catherine's, Ontario, Canada. For instance, the Spiro Lox Model RST 131 can be used for 1 ¼" polished rods, and the grooves at the bottom of the guide are preferably 0.100" in depth and 0.075" wide.

When the fitting 11' is rotated in a direction causing the shoulder 12' to move downwardly against the external shoulder 64 of the guide member 60, the packing coils 23' in the pack off unit are compressed against the lower rod guide member 66. However, the extent or degree of compression required of the packing coils is lessened both in the pack off unit 7' and upper stuffing box unit 6' by utilization of the scraper rings 74. Thus, the scraper rings will act as a primary seal in the pack off unit and reduce the amount of pressure exerted on the packing coils. The scale build-up on the polished rod R' is very abrasive and will wear the packing severely to cause premature leakage of oil, gas and water; however, the scraper rings 74 have been found to be extremely effective in scraping off the scale build-up on the rod as well as to reduce the amount of solid materials that would otherwise enter the stuffing box assembly and tend to contaminate the packing. The scraper rings also act as an effective grease retainer when grease is applied to the polish rod R' and will function to wipe any excess grease from the rod and retain it in the lower pack off unit to afford sufficient lubrication between the assembly and rod R'; otherwise, in the absence of the scraper ring 74, the grease would be drawn upwardly through the entire assembly and be consumed by the production fluids in the well.

It is therefore to be understood that while a preferred form of invention has been set forth and described herein, various modifications and changes may be made in the construction and arrangement of parts without departing from the spirit and scope of the present invention as defined by the appended claims.

I claim:

1. In well pumping apparatus wherein a stuffing box is mounted at the upper end of a wellhead and a polished rod is reciprocal along a vertical path through said stuffing box, the improvement comprising:

a bearing assembly disposed in an annular cavity in said stuffing box, said bearing assembly having rod guide members at opposite ends of said stuffing box, packing coils in said stuffing box interposed between said rod guide members, said rod guide members being of annular configuration and including a rod guide member at least on one of said opposite ends of said stuffing box having an enlarged external shoulder portion and a reduced diameter, elongated rigid liner interposed in an annular space between an end of said stuffing box and said polished rod, force-exerting means bearing against said shoulder portion for exerting compressive force on said packing coils, and at least one scraper ring mounted under radial compression in an internal groove in said liner, each said scraper ring being in the form of a spiral coil completely encircling said polished rod, and said liner having a uniform internal diameter completely encircling said scraper ring and said polished rod.

2. In well pumping apparatus according to claim 1, including a pair of said rod guide members at the top and bottom of said stuffing box and said force-exerting means exerting an axial compressive bearing force on each pair of said rod guide members to compress said packing coils into engagement with the external surface of said polish rod.

3. In well pumping apparatus according to claim 1, each of said rod guide members composed of an inert material selected from brass or bronze.

4. In well pumping apparatus wherein a stuffing box assembly is mounted at the upper end of a wellhead and a polished rod is reciprocal along a substantially vertical path through said stuffing box assembly to induce the flow of fluids through a production string from a subsurface formation, the improvement comprising:

said stuffing box assembly provided with a plurality of annular cavities in axially spaced relation to one another, an internal shoulder portion between said cavities and at opposite ends of said cavities, a bearing assembly in each of said cavities, each bearing assembly having a pair of rod guide members at opposite ends thereof and packing coils interposed between said rod guide emembers in each said assembly, said stuffing box including means exerting a compressive force on each pair of said rod guide members and packing coils therebetween, at least one of said rod guide members of a pair having an annular enlarged external shoulder potion and an elongated liner portion which projects through the annular space between said polished rod and one of said opposite ends of said cavities, and including scraper rings mounted in snug-fitting relation to axially spaced grooves in said lower liner, said scraper rings each being in the form of a spiral coil mounted under radial compression in each of said respective grooves to bear against said polished rod.

5. In well pumping apparatus according to claim 4, said stuffing box assembly having hollow cylindrical wall portions threadedly connected to one another, and said compressive force-exerting means defined by a cap at an upper end of said stuffing box threadedly connected to one of said wall portions.

* * * * *